US010900178B2

(12) United States Patent
Stadler et al.

(10) Patent No.: US 10,900,178 B2
(45) Date of Patent: Jan. 26, 2021

(54) TRACK MAINTENANCE MACHINE AND METHOD FOR CONSOLIDATION OF A BALLAST BED

(71) Applicant: PLASSER & THEURER EXPORT VON BAHNBAUMASCHINEN GESELLSCHAFT M.B.H., Vienna (AT)

(72) Inventors: Lothar Stadler, Vienna (AT); Gerard Lintz, Bening-les-Saint-Avold (FR); Philippe Crovisier, Fletrange (FR)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 287 days.

(21) Appl. No.: 16/074,498

(22) PCT Filed: Jan. 19, 2017

(86) PCT No.: PCT/EP2017/000061
§ 371 (c)(1),
(2) Date: Aug. 1, 2018

(87) PCT Pub. No.: WO2017/140408
PCT Pub. Date: Aug. 24, 2017

(65) Prior Publication Data

US 2019/0040588 A1 Feb. 7, 2019

(30) Foreign Application Priority Data

Feb. 16, 2016 (AT) ..... A 78/2016

(51) Int. Cl.
*E01B 27/20* (2006.01)
*E01B 1/00* (2006.01)

(52) U.S. Cl.
CPC ..... *E01B 27/20* (2013.01); *E01B 1/001* (2013.01)

(58) Field of Classification Search
CPC ..... E01B 1/001; E01B 27/20; E01B 27/12; E01B 27/13; E01B 27/16; E01B 27/17
See application file for complete search history.

(56) References Cited

U.S. PATENT DOCUMENTS 895,964 A * 8/1908 Chruszczyk ..... E01B 27/16 104/12
4,063,516 A * 12/1977 Theurer ..... E01B 27/027 104/12

(Continued)

FOREIGN PATENT DOCUMENTS

CA 1295188 C 2/1992
DE 2608372 A1 12/1976

(Continued)

*Primary Examiner* — Mark T Le
(74) *Attorney, Agent, or Firm* — Laurence A. Greenberg; Werner H. Stemer; Ralph E. Locher

(57) ABSTRACT

A track maintenance machine, constructed to be mobile on a track, for consolidation of a ballast bed underneath a track, includes a machine frame supported on an undercarriage and a consolidating device, connected to the machine frame, which includes at least one consolidating element constructed to be lowered. The consolidating element is constructed as a consolidating plate which, in a working position, is larger in a longitudinal direction of the track than a distance between two sleepers of the track, and the consolidating plate is disposed to be rotatable in order to turn the consolidating plate into a passing position for lowering or raising between two sleepers. A method for consolidation of the ballast bed underneath a track by using a track maintenance machine is also provided.

8 Claims, 1 Drawing Sheet

(56) References Cited

U.S. PATENT DOCUMENTS

| | | | | |
|---|---|---|---|---|
| 4,088,077 | A | 5/1978 | Von Beckmann | |
| 4,489,658 | A | 12/1984 | Von Beckmann | |
| 2012/0024851 | A1* | 2/2012 | Strasser, Sr. ..... | B65D 88/127<br>220/211 |

FOREIGN PATENT DOCUMENTS

| | | | |
|---|---|---|---|
| DE | 2711250 | A1 | 9/1977 |
| EP | 0239712 | A1 | 10/1987 |
| EP | 0551835 | A1 | 7/1993 |
| WO | 2006089587 | A1 | 8/2006 |

* cited by examiner

TRACK MAINTENANCE MACHINE AND METHOD FOR CONSOLIDATION OF A BALLAST BED

BACKGROUND OF THE INVENTION

Field of the Invention

The invention relates to a track maintenance machine, designed to be mobile on a track, for consolidation of a ballast bed underneath a track, including a machine frame supported on an undercarriage and a consolidating device, connected to the machine frame, which comprises at least one consolidating element designed to be lowered. The invention further relates to a method for consolidation of the ballast bed underneath a track by means of a track maintenance machine of this kind.

Description of the Related Prior Art

Various track maintenance machines are provided for consolidating the ballast bed underneath a track. In particular, a vertical static load is applied to the ballast by means of consolidating tools vibrating within a certain frequency range, until the desired condition of the ballast density is achieved.

In different track sections, varying demands are made on the machines. Switches are track sections which are especially stressed. In this, it is particularly important to create a base in the shape of a ballast bed which has been consolidated in several layers, in order to be able to keep the rails precisely at the required level.

SUMMARY OF THE INVENTION

It is the object of the invention to show an improvement versus the prior art for a track maintenance machine of the type mentioned at the beginning. A further object lies in disclosing a method for consolidation of a ballast bed by means of an improved track maintenance machine.

According to the invention, this object is achieved with a track maintenance machine constructed to be mobile on a track, for consolidation of a ballast bed underneath a track, including a machine frame supported on an undercarriage and a consolidating device, connected to the machine frame, which includes at least one consolidating element constructed to be lowered, in which the consolidating element is constructed as a consolidating plate which, in a working position, is larger in a longitudinal direction of the track than a distance between two sleepers of the track, and the consolidating plate is disposed to be rotatable in order to turn the consolidating plate into a passing position for lowering or raising between two sleepers. This object is also achieved by a method for consolidation of the ballast bed underneath a track by using a track maintenance machine according to the invention, wherein a vertical static load is applied to the ballast bed until the desired ballast condition of the ballast density has been achieved, in which the consolidating plate lowered between the sleepers is turned into the working position and shifted in the longitudinal direction of the sleepers in a hollow space between the sleepers and the ballast bed. Dependent claims concern advantageous embodiments of the invention.

The invention provides that the consolidating element is designed as a consolidating plate which, in a working position, is larger in a longitudinal direction of the track than a distance between two sleepers of the track, wherein the consolidating plate is arranged to be rotatable in order to turn the consolidating plate into a passing position for lowering or raising between two sleepers.

The initial position of the raised consolidating plate is defined as the passing position. In this position, the consolidating plate is lowered between the sleepers. Underneath the sleepers, the consolidating plate is turned into the working position. The working position defines that position in which the consolidating plate is turned with respect to its geometry and longitudinal extension in such a way that the greatest possible area under the sleepers is consolidated.

An essential advantage of the invention is the fact that, by means of the track maintenance machine, the ballast under the raised track is introduced in layers, graded and consolidated. In this manner, an even greater stability and life span of the ballast bed is achieved.

The invention provides that the consolidating plate lowered underneath the sleepers is turned into the working position in order to be able to consolidate a larger area of the ballast bed.

It is advantageous if the consolidating device is designed to be displaceable in the longitudinal direction of the sleepers. Thus, any desired consolidating position can be assumed.

A simple manifestation provides that, for the rotary motion of the consolidating plate, the consolidating device connected to the machine frame is provided with a drive which acts upon a lever mounted on the consolidating device and thus causes the rotary motion.

A further advantageous detail of the device is that the drive for the rotary motion is of hydraulic design.

It is also possible that, for the rotary motion of the consolidating plate, the consolidating device connected to the machine frame is provided with an electrical actuating drive and thus causes the rotary motion.

An additional advantage exists if the consolidating device is provided with vibration generators in order to achieve an even more effective consolidation of the ballast bed.

In the method according to the invention, it is essential that the consolidating plate lowered between the sleepers is turned into the working position and shifted in the longitudinal direction of the sleepers in a hollow space between the sleepers and ballast bed.

The productivity of the method is enhanced in that the consolidating plate lowered between the sleepers is used to grade the ballast bed by way of its rotary motion. With this, the ballast is distributed evenly prior to the actual consolidation.

BRIEF DESCRIPTION OF THE DRAWINGS

The invention will be explained below by way of example with reference to the attached figures. There is shown in schematic representation in.

DESCRIPTION OF THE INVENTION

Figure 1:
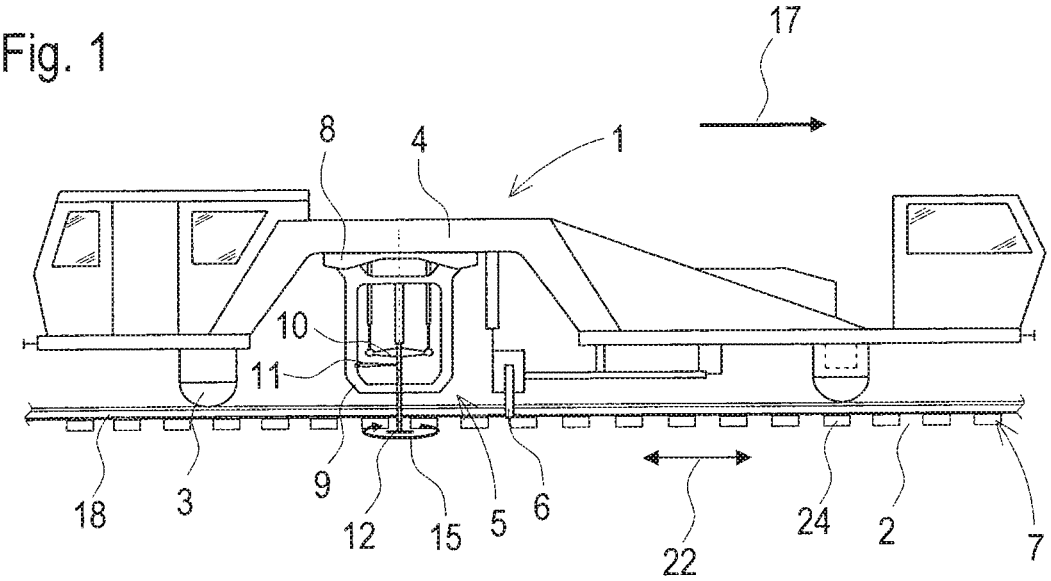
FIG. 1 a track maintenance machine having a consolidating device.

The track maintenance machine 1 shown in FIG. 1 is a machine for consolidating the ballast bed 2, including a machine frame 4 which is supported on an undercarriage 3 and has several adjustable devices, such as a consolidating device 5 and a gripping device 6 for lifting and/or lining a track 7. The consolidating device 5 consists essentially of a main frame 8, at least one support frame 9, a lowering device 10 and, for turning a consolidating plate 12, a rotation device 11 which comprises a hydraulic or electric drive 13. For example, a hydraulic cylinder is connected to a lever 14 to cause the rotary motion 15. In FIG. 1, the consolidating plate 12 is shown in the working position 16.

In working operations, the track maintenance machine 1 moves with a prescribed speed in the working direction 17. The gripping device 6 encompasses two roller tongs per rail 18, arranged one following the other in the working direction 17.

Figure 2:
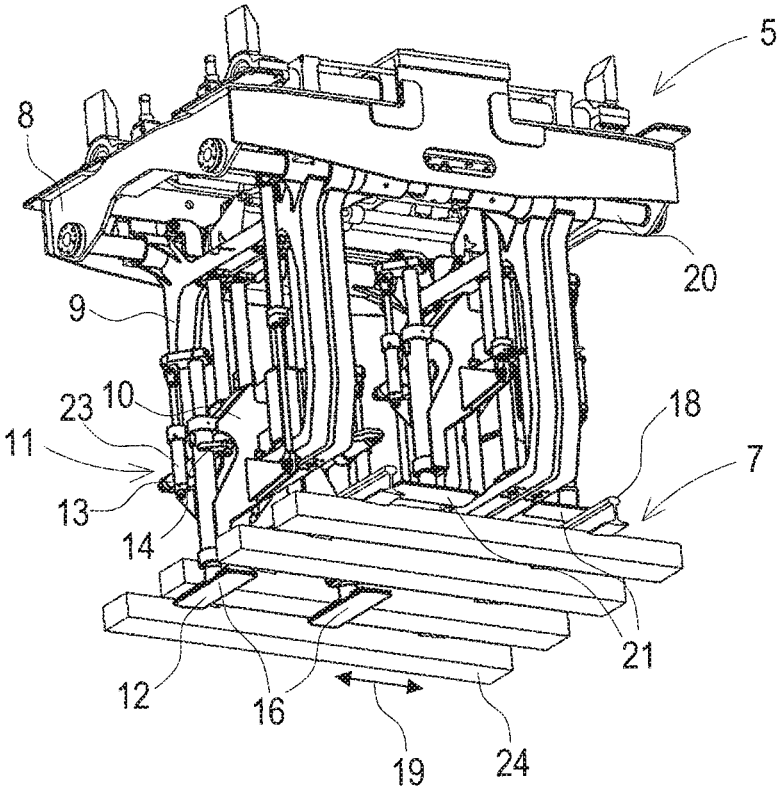
FIG. 2 a consolidating device having consolidating plates.

The consolidating device 5 represented in FIG. 2 shows the main frame 8 in which two guide devices 20 are arranged in the longitudinal direction 19 of the sleepers for displaceable reception of four support frames 9. Two consolidating plates 12 are shown in the passing position 21 and in the working position 16, respectively. The working position is obtained by means of the lowering device 10 and the rotation device 11. The working position 16 has been reached when the longer side of the rectangular designed consolidating plate 12 is aligned parallel to the longitudinal direction 22 of the track. By means of vibration generators 23, an even better consolidation of the ballast bed 2 is achieved.

In an embodiment not shown, the passing position 21 is attained in that the consolidating plate 12 is mounted for rotation on a horizontal axis, extending in the longitudinal direction 19 of the sleepers, and is angled by means of an adjustment device in order to be able to lower it between the sleepers 24.

As a rule, the consolidation underneath the sleepers 24 takes place during cleaning or renewing the ballast bed 2 with a track maintenance machine 1 configured as a cleaning machine. First, old ballast is removed underneath the sleepers 24 by means of a clearing chain or a suction device. During this, the rails 18 and sleepers 24 are held in position by means of the gripping device 6. A newly introduced first ballast layer is consolidated by means of the machine 1 according to the invention, before the new ballast bed 2 is finished by introduction and tamping of a further ballast layer.

The invention claimed is:

1. A track maintenance machine configured to be mobile on a track for consolidation of a ballast bed underneath the track, the track maintenance machine comprising:

an undercarriage;

a machine frame supported on said undercarriage; and a consolidating device connected to said machine frame for applying a vertical static load to the ballast bed, said consolidating device including at least one consolidating element configured to be lowered;

said at least one consolidating element being constructed as a flat and rigid consolidating plate having a working position being larger in a longitudinal direction of the track than a distance between two sleepers of the track; and a rotation device for rotating said at least one consolidating plate to cause a rotary motion for turning said at least one consolidating plate into a passing position for lowering or raising said at least one consolidating plate between two sleepers of the track.

2. The track maintenance machine according to claim 1, wherein said consolidating device is displaceable in a longitudinal direction of the sleepers.

3. The track maintenance machine according to claim 1, wherein said consolidating device connected to said machine frame includes a lever mounted on said consolidating device and said rotation device includes a drive acting upon said lever and causing the rotary motion of said consolidating plate.

4. The track maintenance machine according to claim 3, wherein said drive causing said rotary motion is a hydraulic drive.

5. The track maintenance machine according to claim 1, wherein said rotation device includes an electrical actuating drive causing the rotary motion of said consolidating plate.

6. The track maintenance machine according to claim 1, wherein said consolidating device includes vibration generators for improving consolidation of the ballast bed.

7. A method for consolidation of the ballast bed underneath a track, the method comprising the following steps:

providing a track maintenance machine including:

an undercarriage, a machine frame supported on the undercarriage, and a consolidating device connected to the machine frame, the consolidating device including at least one consolidating element configured to be lowered;

the at least one consolidating element being constructed as a flat and rigid consolidating plate having a working position being larger in a longitudinal direction of the track than a distance between two sleepers of the track; and a rotation device for rotating the at least one consolidating plate to cause a rotary motion for turning the at least one consolidating plate into a passing position for lowering or raising the at least one consolidating plate between two sleepers of the track;

applying a vertical static load to the ballast bed until achieving a desired ballast density condition; and lowering the consolidating plate between the sleepers, then using the rotation device to cause the rotary motion for turning the consolidating plate into the working position and then shifting the consolidating plate in a longitudinal direction of the sleepers in a hollow space between the sleepers and the ballast bed.

8. The method according to claim 7, which further comprises applying the rotary motion to the consolidating plate lowered between the sleepers to grade the ballast bed.

* * * * *